United States Patent [19]

Zarges et al.

[11] Patent Number: 4,589,209

[45] Date of Patent: May 20, 1986

[54] WOODWORKING PLANE

[75] Inventors: Frank W. Zarges, Bismarckstrasse 26, D-8130 Starnberg; Gerd Stiegler, Freiberg, both of Fed. Rep. of Germany

[73] Assignee: Frank W. Zarges, Starnberg, Fed. Rep. of Germany

[21] Appl. No.: 586,674

[22] Filed: Mar. 6, 1984

[30] Foreign Application Priority Data

Mar. 8, 1983 [DE] Fed. Rep. of Germany ..... 3308192
Apr. 12, 1983 [DE] Fed. Rep. of Germany ..... 3313110

[51] Int. Cl.[4] ..... B27G 17/02

[52] U.S. Cl. ..... 30/478; 30/487; 30/488

[58] Field of Search ..... 145/5 R, 11, 13

[56] References Cited

U.S. PATENT DOCUMENTS

| | | | |
|---|---|---|---|
| 556,835 | 3/1896 | Smith | 145/11 |
| 619,394 | 2/1899 | Converse | 145/11 |
| 636,830 | 11/1899 | Miller | 145/11 |
| 640,546 | 1/1900 | Dresser | 145/11 |
| 1,645,781 | 10/1927 | Szako | 145/11 |
| 2,191,679 | 2/1940 | O'Byrne | 145/11 |
| 4,015,649 | 4/1977 | Gilbert | 145/11 |

FOREIGN PATENT DOCUMENTS

| | | | |
|---|---|---|---|
| E 5917 | 11/1955 | Fed. Rep. of Germany | 145/13 |
| 1371524 | 10/1974 | United Kingdom | 145/5 |

*Primary Examiner*—Frederick R. Schmidt
*Assistant Examiner*—J. T. Zatarga
*Attorney, Agent, or Firm*—Max Fogiel

[57] ABSTRACT

A plane with an interchangeable iron that can be displaced at an angle to the contact surface of the plane frame, along the direction in which the plane travels. The iron is also displaceable on each side of a midposition parallel to the contact surface of the plane and transversely with respect to the direction in which the plane travels. The iron is secured in a predetermined position by a support that has a holder against which the iron rests. A support component can be displaced transversely on a frame. The holder is mounted on the support component, so that it can be displaced longitudinally and transversely with respect to the bottom contact surface of the plane.

14 Claims, 13 Drawing Figures

Figure 1:
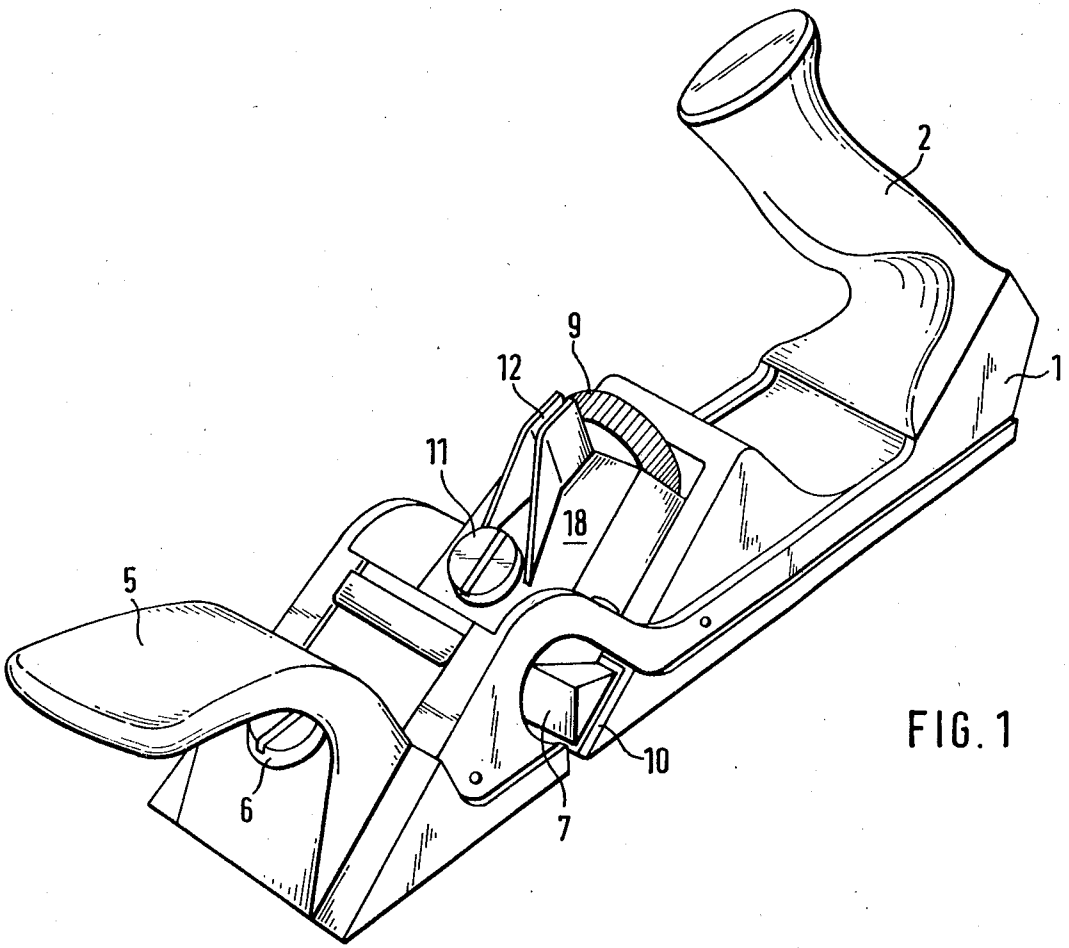

1
2
3
4
5
6
7
8
9
10
12
13
14
15
16
19
20
21
22
25
26
28
29
35
41
66
67
68
69

1
5
6
7
10
11
18
23
24
26
27
66
68

FIG. 4
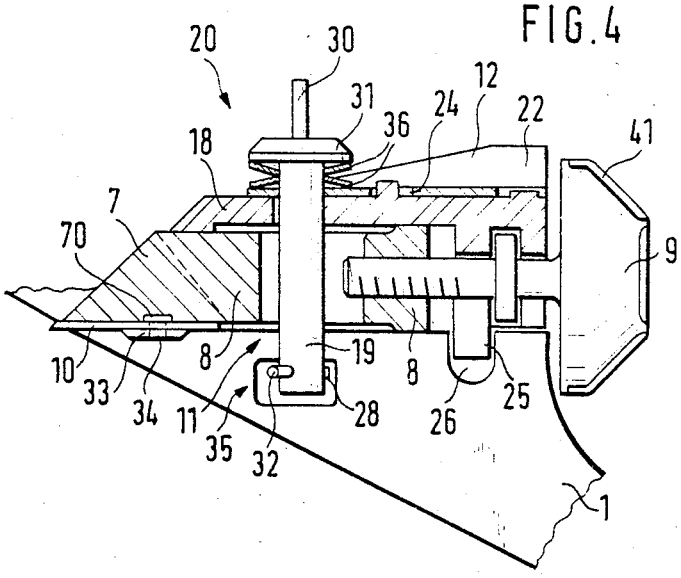
FIG. 4A
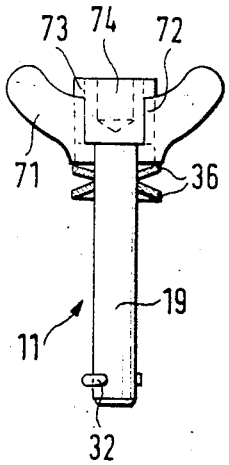
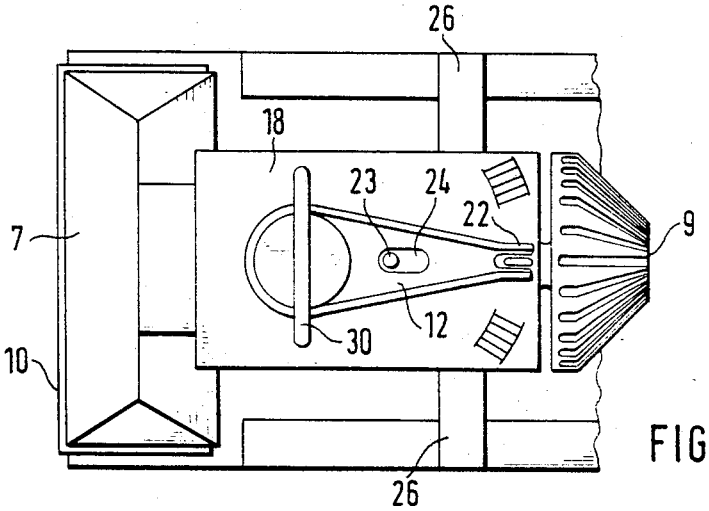
FIG. 5

WOODWORKING PLANE

The invention concerns a woodworking plane with the characteristics in the preamble to claim 1.

A known plane of this type (German Utility Model No. 8 025 250) is designed in a way that is in itself widely known so that the latch can be continuously shifted into various positions along the length of the plane or in the direction in which the plane travels and at an angle to the contact surface of the sole of the plane. The iron is accommodated in a holder that is positioned on the frame in such a way that it can be displaced along the direction in which the iron is adjusted. Since there is a total of three of these displacement guides, one in the middle, one on the right, and one of the left, the iron can be positioned transversely with respect to the length of the plane in a total of three different, rigidly defined guides. The iron can accordingly be positioned off center in either of the two lateral guides in such a way as to arrive either on the right or on the left in the vicinity of the lateral limit of the contact surface of the plane.

This displacement to the vicinity of the side can accordingly occur only to the right and to the left and in one step out of the middle and, in order to vary the position of the iron transversely with respect to the plane or transversely with respect to the direction of travel, the holder must be loosened enough to be transferred from one guide groove into another.

In another known plane the iron can be displaced transversely by releasing the support for the iron and shifting the iron into the desired position manually. This way of transversely adjusting the iron is not only a lot of trouble and dangerous when the blade is sharp, but can also be only rarely carried out precisely because the iron tends to get displaced in the geometrical plane of the sheet of the iron when the support is released.

The object of the invention is to provide a woodworking plane of the aforesaid type in which the iron can be continuously and precisely adjusted even transversely without the support for the iron having to be separated from the frame and without releasing the iron from its holder.

With a woodworking plane having the characteristics in the preamble to claim 1 as a point of departure, the object is achieved in accordance with the invention through the characteristics in the body of that claim.

The design of the support for the iron in accordance with the invention in the form of a compound slide makes it possible to displace the iron not only longitudinally and at an angle to the contact surface of the plane but also transversely and parallel to the contact surface into any desired position. The length of the path of transverse displacement is simultaneously selected so that the iron can be displaced beyond the lateral limiting edge of the contact surface and it becomes possible to employ appropriately laterally ground irons to plane a workpiece surface that is perpendicular to the surface on which the contact surface of the plane is traveling. This is preferably the case in each direction of transverse displacement.

The compound slide can be designed in various ways. One preferred embodiment has a holder that the iron rests against and a support component that can be displaced transversely on the frame, with the holder mounted in such a way on the support component that it can be displaced longitudinally and transversely with respect to the contact surface of the plane.

Another preferred embodiment of the compound slide has a holder that the iron rests against and a support component that can be displaced longitudinally and transversely with respect to the contact surface on the frame, with the holder mounted in such a way on the support component that it can be displaced transversely.

A manually activated threaded bolt can also be provided to adjust the iron longitudinally and transversely with respect to the contact surface. Depending on the design of the compound slide, the threaded bolt engages a thread on the holder or a thread on the support component.

An adjusting member is preferably provided to displace the iron transversely, with a reduced-travel gear designed between the adjusting member and the holder. The adjusting member can simultaneously be designed as a pivoting lever with the end that is remote from the purchase being mounted in such a way that it can pivot around a shaft that is rigidly positioned on the frame and with the section between the pivot and the purchase connected in a transmitting relation to the support component. Another embodiment has a common adjusting member that governs the displacement of the iron not only longitudinally and transversely with respect to the contact surface but also in a transverse direction. An adjusting member of this kind can be designed as a threaded adjustment bolt that can be coupled in various axial displacement positions not only to the holder alone but also to the support component.

In one especially preferred embodiment the support for the iron in the form of a compound slide is designed as a self-contained subassembly that can be secured to the frame by a tensioning element. The tensioning element can then assume a midposition between a loosened position in which the support for the iron can be released from the frame and a tensioning position in which the iron is secured in a particular position with respect to the frame, with the components of the compound slide capable of being displaced mutually and in relation to the frame along compound-slide guides by means of the adjusting member or members subject to the lighter tension that occurs when the tensioning element is in the midposition.

The tensioning element, which preferably engages the support for the iron through a compression spring, can be designed as a manually activated screw, a tilting lever, or a similar mechanism.

In order to use the plane as a cornice plane as well, the iron in another preferred embodiment is positioned at the midsection or front of the plane as desired and supported along with the support for the iron as a whole, which constitutes a single sub-assembly, on matching accommodating surfaces of the frame. The particular tensioning element employed also remains with the support in the two possible operating positions, producing identical anchoring structures at the bottom of the contact surfaces of the frame. An auxiliary handle with means of attachment that also match the anchoring structures can also be mounted on the frame contact surface, which always remains clear.

To counteract wear on the contact surface and in particular to adapt to sliding properties with respect to the material being worked and the contact surface of the plane, the bottom contact surface consists of soles fastened to the frame in such a way that they can be interchanged. The interchangeability of the soles also allows frictional phenomena to be counteracted and provides a potential for adapting the particular sole being employed to the thickness of the iron.

Instead of the soles that are employed for planing, other types of sole can also be employed as desired with a contact surface that widely extends the universal applicability of the plane in the sense of a smoothing tool. Soles of this kind can be designed with respect to their contact surface as rasps or can have a rubber cover to support a piece of sandpaper or emery cloth, etc. A tool element that is as independent as sandpaper can in principle also be mounted on the sole employed for planing.

Adaptation to blades of various thickness can preferably be carried out or the tension of the iron adjusted by means of a tensioning element that can be adjusted in length with a threaded mechanism. The rapid closure provided by the tensioning element is accordingly complemented by a fine-adjustment potential.

To facilitate handling the iron, one preferred embodiment of the invention has a permanent magnet in the vicinity of the iron-holding system, especially in the bottom surface of the holder, that secures the iron against unintentional removal while it is being handled.

Because of the wide range of purposes for which the plane can be employed, both at its contact surface and at the side, various demands are made on the irons with respect to their cutting edges. For this reason irons that are employed in one direction are stored, preferably in a magazine mounted in such a way as to be accessible at any time in the main handle of the plane. The iron itself can be attached to the holder simply and in such a way that it can be replaced because projections are constructed on the contact surface of the holder that fit into bores in the main part of the iron in such a way that the iron will rest secured against displacement on the holder even when the tensioning element releases the support for the iron to adjust the iron or when the main part of the iron is completely separated from the frame.

Further preferred designs for the invention will be evident from the subsidiary claims in conjunction with the embodiments illustrated by way of example in the the drawings, to which reference is made in particular and the following description of which will elucidate the invention in greater detail.

Figure 2:
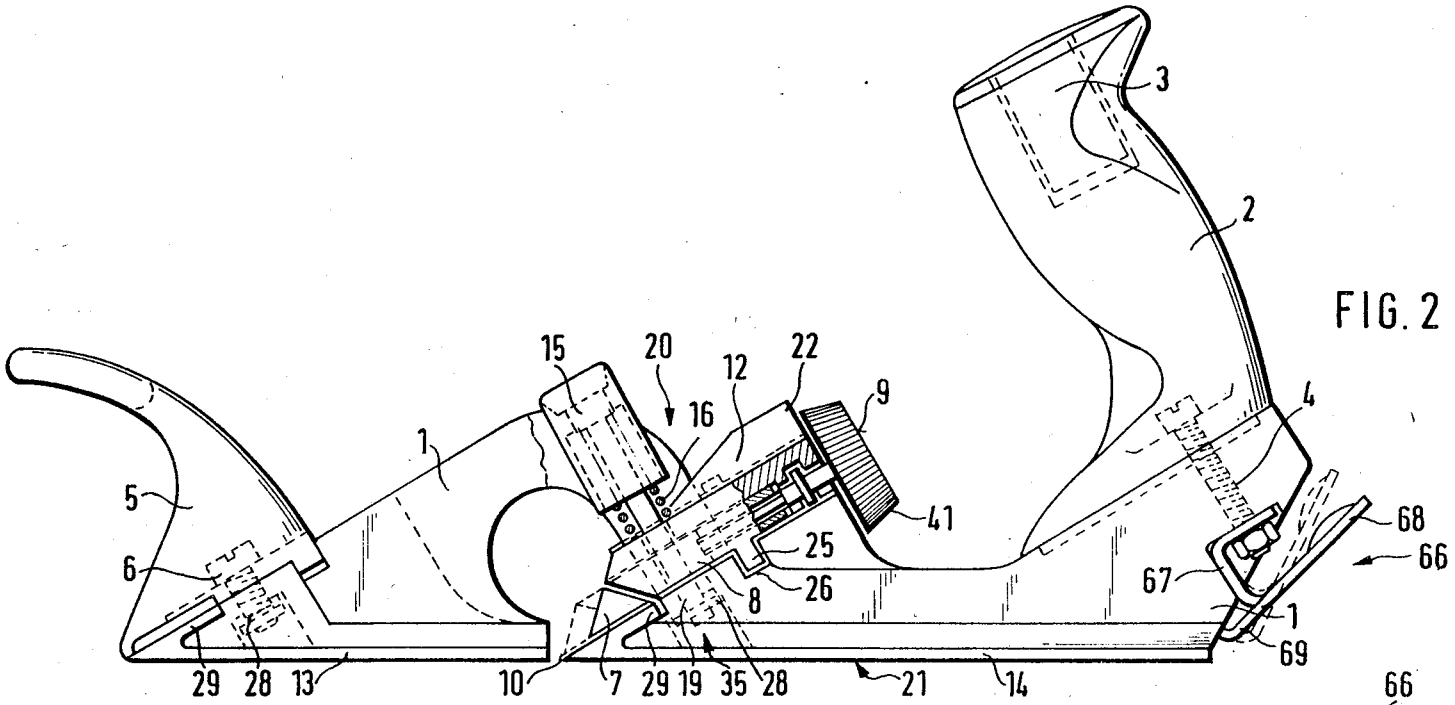
Figure 3:
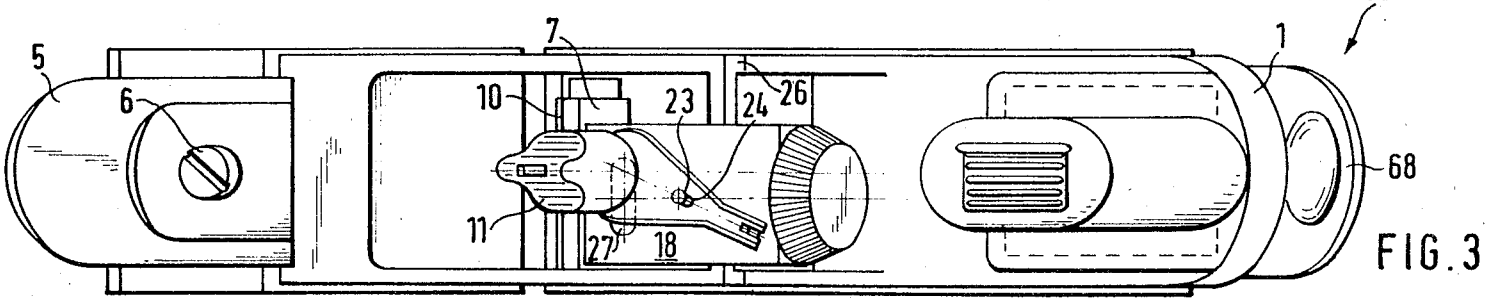
Figure 6:
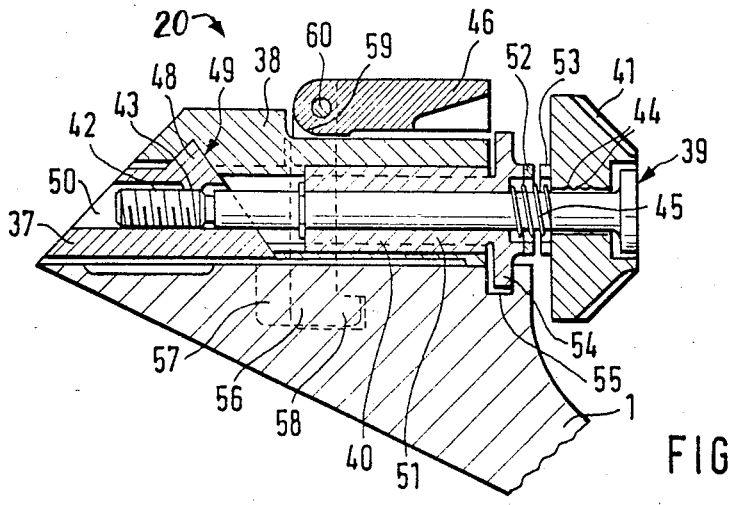
Figure 7:
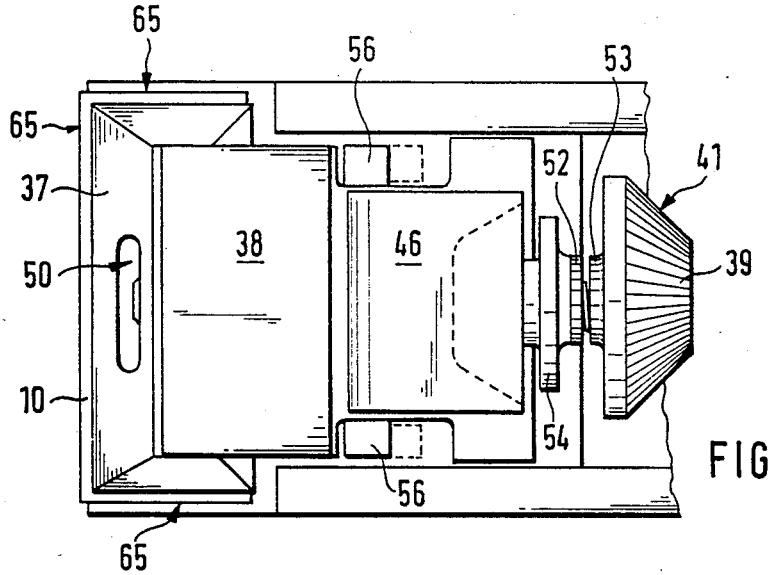
Figure 8:
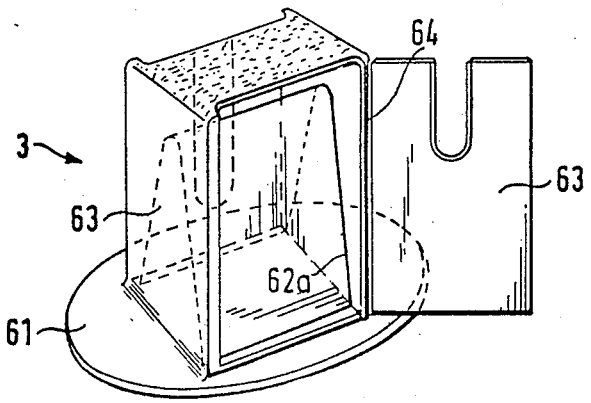
Figure 9:
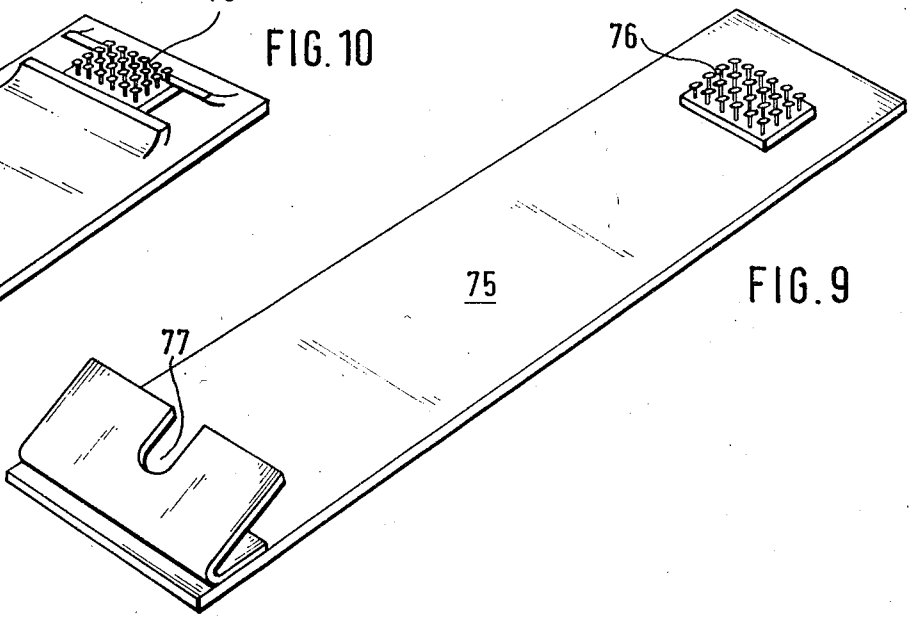
Figure 10:
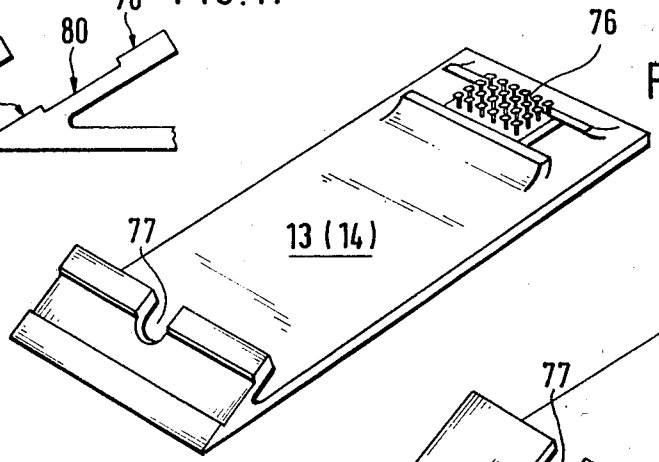
Figure 11:
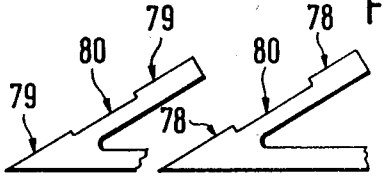
Figure 12:
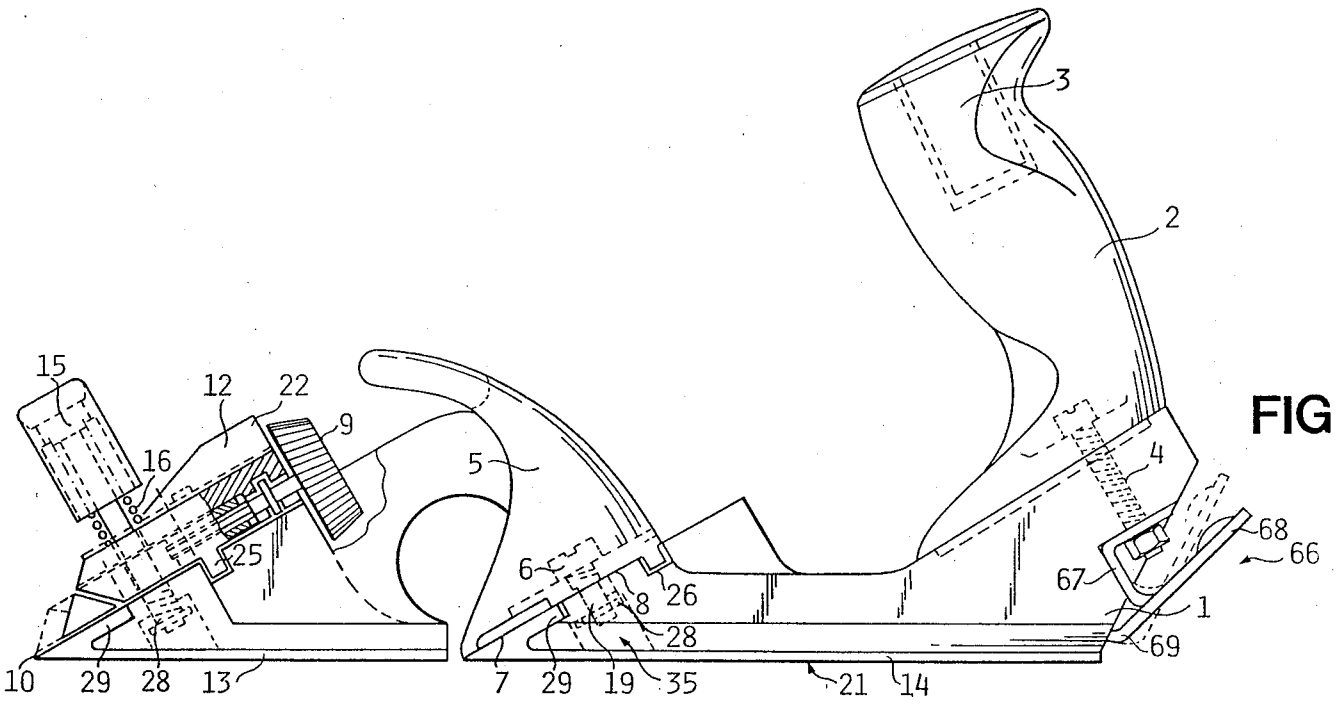

FIG. 1 is a perspective drawing of one embodiment of the plane,

FIGS. 2 and 3 are a partly sectional side view and a top view of the plane in FIG. 1, FIGS. 4, 4*a*, and 5 are a partly sectional magnified partial view of the vicinity of the support for the iron from the side and top in extensive agreement with the corresponding design of the plane illustrated in FIG. 1, FIGS. 6 and 7 are a lateral section and a top view of the vicinity of the support for the iron in a second embodiment by way of example, FIG. 8 is a perspective view of one embodiment of the blade magazine, FIG. 9 is a perspective view of a sole with a contact surface in the form of a rasp, FIG. 10 is a perspective view of a sole with a rapid attachment and a position-maintenance device, FIG. 11 is two side views of the vicinity of the contact between the iron and a sole with structures designed for adapting to irons of various thicknesses, and FIG. 12 is a partly sectional/side view of the tensioning element with rapid closure.

FIGS. 1 through 3 show a plane with a frame 1 that has a main handle 2 in the vicinity of its end and a blade magazine 3 inserted inside the main handle in the vicinity of the end that points away from the frame. Main handle 2 is attached to frame 1 in such a way that it cannot rotate by a screw 4 and by flat mating surfaces that are not illustrated in the area of contact between main handle 2 and frame 1. An auxiliary handle 5 is fastened by a rapid-fastening screw 6 to frame 1 at the front.

A support, designated by 20 overall, for an iron consists first of a holder 7 that is rigidly fastened to a guide component 8, which is mounted in a support component 18 in such a way that it can be displaced along the plane or along the direction in which the plane travels and at an angle to the contact surface 21 of the plane. A screw bolt that can be manually operated is accommodated in such a way that it can be turned but cannot be longitudinally displaced in the support component and is introduced with its threaded bolt in a corresponding matching thread in guide component 8. The support component has a projecting structure 25 that engages a groove 26 that extends in frame 1 transversely with respect to the direction of the plane and parallel to contact surface 21. The support component is accordingly secured against displacements along the shaft of the screw bolt. When screw 9 is turned, guide component 8 and hence holder 7 are displaced in the aforesaid direction as the result of the engagement between the threads so that an iron 10 positioned on the bottom of holder 7 can be set at an angle to more or less of an extent out of contact surface 21. Iron 10 is secured against displacement in a way that is not illustrated at the bottom surface of holder 7 by nipple-like projections on the bottom surface of the holder that engage appropriately positioned and dimensioned apertures in the main part of the iron. The iron thus assumes its correct seating with respect to the holder and is even subject to a certain amount of clamping to the extent that the iron cannot get loose from the holder by itself. Nevertheless, the iron can easily be separated from the holder and replaced with another iron.

A tensioning element 11 in the form of a screw extends perpendicular to the guiding direction of guide component 8 and perpendicular to the transverse course of groove 26 through both an oblong aperture 27 that extends transversely in support component 18 and through a rectangular aperture, not illustrated, in guide component 8, engaging an anchoring structure 28 below the contact surface 29 of frame 1, on which support 20 for iron 10 rests, exhibiting the same angled direction as the guiding direction of guide component 8. This contact surface is interrupted transversely by groove 26.

A pivoting lever 12 is mounted in such a way that it can swing around the shaft 19 of helical tensioning element 11 in the vertical longitudinal midplane of the plane, as will be especially evident from FIGS. 1 and 3. The lever extends with its lower side parallel to the upper surface of support component 18 and can be displaced, because of the particular geometry selected, out over this surface during the course of its pivoting motion. Approximately equidistant between the lever's pivot and its other end, which is in the form of a purchase 22, is an oblong hole 24 that extends for a short distance along pivoting lever 12 and is engaged by a pin 23 that is supported by support component 18. When the lever is pivoted, its oblong hole 24 and pin 23 entrain support component 18 to the extent that the component is displaced with its projections along groove 26 and transversely with respect to the length of the plane or the direction in which the plane travels. Pin 23 must, in order to allow this straight displacement of support component 18, describe a corresponding offset motion in oblong hole 24.

FIG. 3 illustrates pivoting lever 12 pivoted almost completely to the left and the linearly displaced position of support component 18 that corresponds to the pivoted position. In this position, iron 10 emerges on the corresponding side beyond its lateral limit so that a wall of material that projects perpendicular to contact surface 21 can be planed. It will be directly evident that, when the lever is pivoted back, the iron will arrive first in a midposition and will finally, as pivoting continues, emerge at the right beyond the right-hand limit of the plane. In that position a wall of material appropriately positioned perpendicular to the contact surface could be worked. Various pivoted positions of pivoting lever 12 can be indicated or established by catches between pivoting lever 12 and support component 18 in such a way that the midposition and outermost right-hand and left-hand pivoted positions are displayed or made perceptible to the touch.

Holder 7 and hence iron 10 participate in the transverse motion of support component 18 because the guidance of guide component 8 is appropriately designed into support component 18.

There is a compression spring 16 between support component 18 and the head 15 of tensioning element 11 that ensures reliable tension of the support 20 for iron 10 with respect to the contact surface 29 of frame 1 when helical tensioning element 11 assumes the corresponding rotation. The end of shaft 19 that points away from head 15 is in the form of part of a rapid closure, the other part of which constitutes an anchoring structure 28 that is accessible from contact surface 29. Rapid closures of this type are known. When the tensioning element is rotated around its axis less that 360°, it assumes three differentiable rotations in each of which the axial distance of tensioning-element head 15 from support component 18 is different. At the rotation for which this distance is the greatest, shaft 19 can be extracted from anchoring structure 28 so that the whole support 20 can be lifted off of contact surface 29. As the tensioning element is driven farther in and rotated into another rotation, a pin travels over a steep plane, so that the distance between head 15 and support component 18 decreases. Since compression spring 16 exerts a relatively slight force on support component 18, the latter can slide with its projections into groove 26 as pivoting lever 29 pivots. Since, subject to this low level of tension, guide component 8 can also easily be displaced by rotating screw bolt 9, the position of iron 10 can be varied with respect to contact surface 21. If the tensioning element is rotated another step, a pin at one end will travel along another steep geometrical plane in the anchoring structure into a limiting position in which the distance of head 15 from support component 18 is shortest. In this position, the correspondingly compressed spring 16 will exert a relatively powerful force on support component 18 and guide body 8, so that the aforesaid adjustment will be prevented or iron 10 will not automatically displace during the subsequent processing of the workpiece.

Auxiliary handle 5 is attached at the front of frame 1 to a contact surface that is identical to the contact surface positioned in the midsection of the place and against which the body 20 of the iron rests in the aforesaid position. The attachment is again established by means of a rapid closure that is designated 35 as a whole and is identical to that previously described herein. If the plane is to be employed as a molding plane, tensioning element 11 is transferred by turning in the opposite direction into the position in which it can be extracted from anchoring structure 28 and rapid closure 35 thus completely released, so that the overall body of the iron can be removed along with tensioning element 11 from its seating against the frame of the plane. The fastening of auxiliary handle 5 can be removed from its seating in the same way by turning rapid-closure screw 6 so that support 20 for iron 10 can now be placed along with tensioning element 11 on the more forward of the two contact surfaces 29, while auxiliary handle 5 is placed on a surface 25 in the vicinity of the middle of the place and secured there.

The multipurpose plane is thus very simple and reliable to operate and simultaneously allows a very fine and continuous adjustment of the iron both longitudinally and transversely. The plane is accordingly especially appropriate for craftsmen who must frequently work away from the shop so that any tools they take with them must be as compact as possible.

As will be evident from FIG. 2, connecting screw 4 retains along with main handle 2 in the rear of frame 1 a two-armed spring that is designated 66 as a whole and incorporates a midsection 67 that exhibits a bent section with a corresponding bore for accommodating the shaft of connecting screw 4. The upward arm is in the form of an activating lever 68 and the other arm, which extends down on the other side of midsection 67 is shaped like a securing lever 69 with a bottom end that is bent in the form of a tensioning clip toward frame 1 and is subject to stress at the rear face of the frame. Two-armed spring 66 can be employed to secure one end of a strip of sandpaper or similar material between the tensioning clip and the rear face of the frame with the strip lying against the bottom of sole 13, 14 (or 75 in FIG. 9) below the plane and with its other end tensioned between the front contact surface 29 of the sole, specifically of the front part 13 of sole 13 or of sole 75 in FIG. 9, and auxiliary handle 5, which can have a clamping nose at the bottom edge for this purpose. The plane can accordingly also be employed as a sander.

The partial section through the vicinity of the support 20 for iron 10 in FIG. 4 illustrates, like the top view in FIG. 5, a somewhat different embodiment, which corresponds nevertheless in function to that of the example illustrated in FIGS. 1 through 3. FIG. 4 evidences a one-piece design between holder 7 and guide component 8 and illustrates how support component 18 is tensioned by guide component 8 against surface 29 of the frame when helical tensioning element 11 is turned, preventing longitudinal displacement of guide component 8 and transverse displacement of support component 18. The helical tensioning element has a rotating grip 30 and collar 31 with saucer springs 36 inserted between the collar and the opposing surface of support component 18. On the free end of shaft 19 is a transverse pin 32 that functions as previously described herein in conjunction with anchoring structure 28 like the rapid closure previously described herein and designated 35 as a whole. As will be evident from the relations previously described herein, the force of the tensioned saucer springs 36 is conducted to iron 10, which has apertures 34 in its head that are engaged by nipples 33 on the bottom surface of holder 7. The seating of the iron is accordingly secured against displacement and the dimensions can be selected so that the iron will not come out of the mount by itself even when its support 20 has been removed.

A permanent magnet 70 can also be positioned in the iron-contact surface of holder 7, preferably next to nipples 33, in such a way that the latter positively engage iron 10 to ensure that it will be entrained during displacement, whereas the permanent magnet 70 in the positive mounting of iron 10 will also function when the holder has been removed, which facilitates handling when inserting and exchanging the iron and during similar operations.

Instead of the tensioning element 11 illustrated in FIG. 4, one like that illustrated in FIG. 4*a* can be employed. The difference is that, instead of the rotating grip 30 in FIG. 4, a wing nut 71 or similar structure screwed into a thread 72 is employed at a thickened head structure 73 on penetrating part 19, whereby the front end of head 73 exhibits an engagement aperture 74 for a screwing tool. Saucer springs 36 rest against the bottom surface of wing nut 71, which accordingly replaces the collar 31 in FIG. 4 or allows an axial lengthwise variation in the effective penetrating part 19 as the result of a relative rotation between wing nut 71 and penetrating part 19. This makes it possible to take the use of irons of different thickness into account as desired and to carry out fine adjustment of the tensioning forces in general. The design for a tensioning element illustrated in FIG. 4*a* can of course also be employed for the rapid-closure screw 6 at the front of the plane.

FIGS. 6 and 7 illustrate part of the vicinity of another embodiment of the support for the iron. The section in FIG. 6 in particular illustrates a holder 37 that accepts as previously described an iron, not illustrated against a surface facing the sole of the frame. The opposite side of holder 37 has a projection 48 that extends transversely with respect to the length of the plane and engages a parallel groove 49 in the surface of support component 18 that faces holder 37. It is accordingly apparent first of all that holder 37 is mounted in such a way that it can be displaced with respect to supporting component 38 as projection 48 slides in groove 49 transversely with respect to the length of the plane or perpendicular to the direction in which the plane travels. This displacement can be initiated by means of a threaded adjustment bolt 39, the free end of which engages an aperture that extends in holder 37 parallel to the shaft of the bolt and transversely thereto in the direction of displacement. The surface of the free end of the shaft of threaded adjustment bolt 39 is in the form of a cogwheel 42 that meshes with a rack structure 43, which extends in the direction of displacement and projects from a corresponding wall of aperture 50. When the threaded adjustment bolt is rotated around its axis, consequently, holder 37 is displaced along its transverse guide 48 and 49.

Support component 38 is mounted along the length of the plane at an angle to sole contact surface 21, specifically symmetrical to the vertical longitudinal midplane and parallel to the contact surface 29 of the frame of the plane, in such a way that it can be displaced. Support component 38 has a bore that extends in the direction of guidance and exhibits, at least along its initial section, an inside thread that is engaged by the outside thread of a bushing 51 in such a way that support component 38 and bushing 51 are mechanically linked by the resulting threaded connection 40. The bushing is secured against axial displacement, although it can still rotate, by a radially projecting contour 54 that engages a depression 55 in the surface 29 of frame 1. The bushing is penetrated by the shaft of threaded adjustment bolt 39 without mechanical linkage and the face of the bushing toward the purchase 41 of threaded adjustment bolt 39 exhibits ring-gear teeth 52 that face corresponding teeth 55 on purchase 41.

The shaft of the threaded adjustment bolt 39 in the present embodiment is secured against withdrawal from bushing 51 by a retaining ring 56. The knob-like purchase 41 of the threaded adjustment bolt is connected to the shaft in such a way, not illustrated, as to prevent mutual rotation although it can be displaced axially along the shaft to a certain extent, specifically against the force of a spring 45 that rests on the one hand against bushing 51 and on the other against purchase 41. The purchase can be displaced toward the bushing against the force of the spring until teeth 52 and 53 engage. The various axially displaced positions of the purchase with respect to the shaft of threaded adjustment bolt 39 are established by catches 44. If the purchase 41 on threaded adjustment bolt 39 is rotated in the displacement catch pointing toward bushing 51, the rotation is transferred through ring-gear teeth 52 and 53 to bushing 51 in such a way that the threaded connection 40 between bushing 51 and support component 38 carries out its offset motion toward the extension of the shaft of threaded adjustment bolt 39. The transverse-displacement engagement between holder 37 and supporting component 38 entrains the holder in this direction. The toothed structure on the free end of the shaft of threaded adjustment bolt 39 is accordingly long enough axially to retain the mesh between cogwheel 42 and rack 43 in any of these displacements.

Thus, one and the same operating mechanism can be employed to transfer the iron both longitudinally, at an angle to the sole of the plane, and perpendicularly thereto into any desired displacement.

The tensioning element in this embodiment is a tilting lever 46 above the side of supporting component 38 that faces away from the contact surface 29 of frame 1. The tilting lever is linked to two anchoring components that extend along both side of supporting component 38, which is narrower in this embodiment, and engage anchoring apertures 57 in the frame that are accessible from contact surface 29. Anchor lugs 58 that project laterally from anchors 56 engage below correspondingly undercut section of anchoring apertures 57 in such a way that when they are in a specific operating position they cannot be pulled more or less perpendicularly out of the contact surface 29 of frame 1. The anchoring apertures are on the other hand shaped in such a way that when anchors 56 are untensioned they can be pulled out of the apertures. This again makes it possible to remove support 20 as an integral unit from contact surface 29 and position it on an appropriate surface at the front of the plane as previously describe herein with reference to the first embodiment. The release position, tensioning, and an intermediate, less powerfully tensioned position in which the iron can be adjusted, can be obtained with tilting lever 46, which engages a round shoulder surface 59 on the side of support component 38 that faces it. The articulation pin 60 that connects tilting lever 46 to the two anchors 56 is offset far enough with respect to the round shoulder surface or to its center of curvature to be at a distance from the surface of support component 38 that the shoulder surface 59 of tilting lever 46 rests against that varies in accordance with the pivoted position of tilting lever 46. When tilting lever 46 is pivoted up, this distance is shortest and articulation pin 60 is near the surface of supporting component 38. This is the untensioned state. In this position, anchors 56 can be moved freely enough in the anchoring apertures to be removed from the apertures because of the overall design of the apertures subsequent to an initial lateral displacement that frees the lug. When tilting lever 46 is pivoted 60° for example, the greater distance between shoulder surface 59 and articulation pin 60 allows anchors 56 to be pulled to a certain extent until holder 37 can be displaced with respect to support component 38 and support component 38 with respect to frame 1 by means of threaded adjustment bolt 39 until the desired position of the iron is obtained. If tilting lever 46 is then folded farther, against support component 38 in the example being described, the distance between articulation pin 60 and the shoulder 59 of tilting lever 46 will increase accordingly. This will increase the traction on anchors 56 to the extent that support component 38 and the holder 37 and iron 10 will be tensioned securely against the contact surface 29 of frame 1. The plane can be operated in this state without the iron leaving the position it has assumed.

A transmission mechanism has been provided between the purchases 22 and 41 of the pivoting lever or of the threaded bolts and the mechanisms that engage the parts that are to be displaced by these adjustment members in all the embodiments described so far herein to allow precise and easy adjustment.

FIG. 1 illustrates the blade magazine 3 that can be inserted in the main handle 2 illustrated in FIGS. 1 through 3 in the state in which it is utilized, removed, that is, from the handle and with the elliptical plate 61 that covers the magazine hole in handle 2 when the magazine is inserted facing down. The box-shaped main section 62 of blade magazine 3 has a wall 63 that can be opened and that is connected to the box by means of a sheet hinge 64. This magazine is especially significant for the multiple-use plane described herein because different edges of the iron get worn down depending on the particular stage of the planing operation, whether, that is, it is a workpiece surface parallel to the contact surface of the sole of the plane that is being planed or a perpendicular vertical surface to one side. The irons that are to be employed in this case usually have a ground cutting edge 65 (FIG. 7) on at least three of their rectangular sides, possibly even all the way around. It would, however, be a waste to throw away a partly worn blade or to store it remote from the plane because experience has shown that this leads to losses. Because of the wide range of application for the present plane outside the shop itself, therefore, it is especially important to be able to transport blades, in addition to replacement blades of course, along with the plane and use them as needed. The blade magazine accordingly has a very specific function in this case. A leaf spring 62*a* can be positioned inside box 62 to prevent the stored blades from moving and to keep them always available at a specific access site.

FIG. 9 illustrates a sole 75 that extends over the total length of the bottom surface of the frame, not illustrated, of the plane. Sole 75 is not used with the tool in the capacity of plane but exhibits a rasp or file structure, not illustrated, on its bottom surface. When sole 75 is mounted on the plane it accordingly becomes an abrasive or filing tool. In another embodiment the plane can have a layer or rubber or similar material on the bottom that functions as a support for a strip of sandpaper as previously described herein with reference to FIG. 2. A layer of rubber of this type mounted on a special sole 75 provides improved support and security for a strip of sandpaper than do the soles 13, 14 for example illustrated in FIG. 2.

Sole 75 also has a structure at the front of the same type illustrated in FIG. 2. Since a plane iron is not intended to be inserted in this case, the surface of the structure that slants up does not function as a contact surface for an iron. There is a rapid attachment 76, at the end of sole 75 that is remote from the structure, that serves instead of the screw otherwise provided for fastening the sole to the base of a frame that is provided with a mating device matching rapid attachment 76. The rapid attachment can be a plug and socket connection or similar device, what is known as a Hedlock fastener for example.

FIG. 10 illustrates a sole 13 or 14 of the type employed when the tool is used as a plane. As will be evident from FIG. 2, the sole consists of two parts to allow an iron to be inserted not only in the vicinity of the middle but also at the front end of the plane. Sole 13 has a structure with a surface that slants up and functions as a contact surface 29 for an iron. At the end of the sole that is remote from this structure there is also a rapid attachment 76 secured between two ribs that are case in one piece with the sole and extend transversely with respect to its length. The ribs are narrower than the sole and engage a correspondingly shaped recess, not illustrated, in the bottom of the frame in such a way that the side edges of the ribs rest against the corresponding side walls of the recess, securing the sole against lateral displacements with respect to the frame.

In the vicinity of the structure there is a notch 77 in approximately the middle of the upper edge of contact surface 29, and a lug on the frame fits into the notch when the sole is mounted on the frame, providing in this case as well a mounting for the sole that stabilizes it against lateral displacement.

FIG. 11 illustrates the vicinity of the structure in two different soles intended for accommodating irons of different thickness. If a very thin iron is employed a sole of the type illustrated on the right of FIG. 11 and in which two elevations 78 extend comparatively high and perpendicular to the length of the plane with a depression 80 positioned between them is utilized. When a thick iron is employed, a sole of the type illustrated on the left of FIG. 11 and in which the support elevations 79 that extend perpendicular to the length of the plane project only slightly above the depression 80 between them. The sum of the height of the support elevation and the thickness of the iron thus always provides the same distance parallel to the tension of the mounting for the iron.

We claim:

1. Plane comprising: a frame with a plane base contact surface; an interchangeable iron displaceable at an angle to the contact surface of said frame along a direction in which the plane travels and on each side of a midposition parallel to said contact surface and transversely with respect to a direction in which the plane travels; a support for securing said interchangeable iron in a predetermied position; said support comprising a compound slide with a holder, said iron resting fixedly against said holder; said compound slide having a support component displaceable transversely on said frame; said holder being mounted on said support component for displacement inclined to said contact surface in longitudinal direction of motion of the plane, said support component being displaceable on said frame parallel to said contact surface and perpendicular to longitudinal displacement of said iron, said iron being displaceable on both sides from a midposition by at least an amount so that a cutting end of said iron can be displaced at least to each outer surface of a neighboring plane side wall.

2. A plane as defined in claim 1, including a manually activated threaded bolt engaging a thread on said holder for adjusting said iron longitudinally and transversely with respect to said contact surface.

3. A plane as defined in claim 1, including an adjusting member for displacing said iron transversely and having a handle gripping portion; and a reduced-travel geared connection between said handle gripping portion and said holder.

4. A plane as defined in claim 3, including a shaft rigidly positioned on said frame; said adjusting member comprising a pivoting lever with an end remote from said handle gripping portion and mounted for pivoting around said shaft; an engagement means between a bolt and an oblong aperture, a section between a pivoting point of said pivoting lever and said handle gripping portion being connected in a transmitting relation to said support component by said engagement means.

5. A plane as defined in claim 1, including a tensioning element for securing said compound slide as a self-contained subassembly, said tensioning element passing through at least one part of said compound slide.

6. A plane as defined in claim 5, wherein said tensioning element can be shifted from a loosened position in which said support for said iron can be released from its connection to said frame into a tensioning position in which said iron is secured in a predetermined position with respect to said frame; and adjusting means, said tensioning element being shiftable into a midposition in which components of said compound slide can be displaced mutually and in relation to said frame by said adjusting means.

7. A plane as defined in claim 5, including spring means, said tensioning element engaging said support through said spring means, said tensioning element comprising screw means.

8. A plane as defined in claim 5, including rotational rapid closure means having three predetermined rotations in each of which a head portion of said tensioning element assumes a different distance from said frame along a direction of tension, said tensioning element engaging said frame through said rotational rapid closure means.

9. A plane as defined in claim 8, wherein said tensioning element has a nut portion at its actuating end, said tensioning element having a penetrating part with a thread onto which said nut portion can be screwed on, plate springs on said penetrating part and in contact with an annular face of said tensioning element.

10. A plane as defined in claim 5, wherein said support can always be positioned lengthwise at a midsection or front of said plane by said tensioning element; an auxiliary handle and rapid closure means for seuring said auxiliary handle on a support surface.

11. A plane as defined in claim 1, including projections on a surface receiving said holder and fitting into correspondingly positioned apertures in said iron, said iron being secured by clamping action by said projections in said apertures.

12. A plane as defined in claim 1, wherein said contact surface has a sole with an acutely-angled structure at front in direction of plane travel and a surface slanting upwards and comprising a contact surface for said iron.

13. A plane as described in claim 1, wherein said contact surface comprises sole portions fastened to said frame, said sole portions being interchangeable.

14. A plane as defined in claim 1, including a handle; a blade magazine positioned in said handle and having spring means, said magazine being slidable in and out of said handle and receiving blades of said iron, said blades being pushed into said magazine against said spring means.

* * * * *